US007510811B2

(12) United States Patent
Matsumura et al.

(10) Patent No.: US 7,510,811 B2
(45) Date of Patent: Mar. 31, 2009

(54) TONER FOR DEVELOPING ELECTROSTATIC IMAGE AND RESIN PARTICLE DISPERISION SOLUTION FOR TONER FOR DEVELOPING ELECTROSTATIC IMAGE

(75) Inventors: Yasuo Matsumura, Minamiashiagara (JP); Hirotaka Matsuoka, Minamiashiagara (JP); Hideo Maehata, Minamiashiagara (JP); Satoshi Hiraoka, Minamiashiagara (JP); Yuki Sasaki, Minamiashiagara (JP); Fumiaki Mera, Minamiashiagara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 468 days.

(21) Appl. No.: 11/302,227

(22) Filed: Dec. 14, 2005

(65) Prior Publication Data

US 2006/0257777 A1 Nov. 16, 2006

(30) Foreign Application Priority Data

May 12, 2005 (JP) ..... 2005-140395

(51) Int. Cl.
*G03G 9/00* (2006.01)

(52) U.S. Cl. ..... 430/108.1; 430/109.4; 430/110.1; 430/137.14; 430/137.15; 528/274; 528/288; 524/186; 524/539

(58) Field of Classification Search ..... 430/108.1, 430/109.4, 110.1, 137.14, 137.15; 528/274, 528/288; 254/186, 539
See application file for complete search history.

(56) References Cited

U.S. PATENT DOCUMENTS

| | | | | |
|---|---|---|---|---|
| 4,355,154 | A | 10/1982 | Saam et al. | |
| 6,054,242 | A * | 4/2000 | Okutani et al. | 430/109.4 |
| 6,582,869 | B2 | 6/2003 | Daimon et al. | |
| 2002/0018952 | A1 | 2/2002 | Daimon et al. | |

FOREIGN PATENT DOCUMENTS

| | | | |
|---|---|---|---|
| CN | 1 332 393 | A | 1/2002 |
| DE | 101 20 010 | A1 | 1/2002 |
| JP | A 63-282752 | | 11/1988 |
| JP | A 2-308260 | | 12/1990 |
| JP | A 06-250439 | | 9/1994 |

OTHER PUBLICATIONS

Takasu et al., "Synthesis of Aliphatic Polyesters by Direct Polyesterification of Dicarboxylic Acids with Diols under Mild Conditions Catalyzed by Reusable Rare-Earth Triflate," Macromolecules, vol. 36, pp. 1772-1774 {2003}.

* cited by examiner

*Primary Examiner*—Mark A Chapman
(74) *Attorney, Agent, or Firm*—Oliff & Berridge, PLC

(57) ABSTRACT

A toner for developing an electrostatic image of the present invention contains toner particles obtained by forming coagulated particles by mixing a resin particle dispersion solution containing dispersed resin particles and a coloring agent dispersion solution containing dispersed coloring agent particles and fusing the coagulated particles by heating them and is characterized in that at least the surfaces of the toner particles have a chemical structure formed by reaction with a compound having a carbodiimido group. The invention also provides a resin particle dispersion solution to be used for the production of toner.

20 Claims, No Drawings

TONER FOR DEVELOPING ELECTROSTATIC IMAGE AND RESIN PARTICLE DISPERISION SOLUTION FOR TONER FOR DEVELOPING ELECTROSTATIC IMAGE

CROSS-REFERENCE TO RELATED APPLICATION

This application claims priority under 35 USC 119 from Japanese Patent Application No. 2005-140395, the disclosure of which is incorporated by reference herein.

BACKGROUND OF THE INVENTION

1. Field of the Invention

The present invention relates to a toner for developing electrostatic image to be used in developing an electrostatic image formed by an electrophotographic method or an electrostatic recording method with a developer and a resin particle dispersion solution for a toner for developing electrostatic image.

2. Description of the Related Art

Today, a method such as an electrophotographic method for visualizing image information via an electrostatic image has been employed in various fields. In the electrophotographic method, an electrostatic image is formed on a photoconductor by charging and exposure steps, and the electrostatic latent image is developed by a developer containing a toner for developing electrostatic image (hereinafter, referred to as a "toner" in some cases) and is visualized by transfer and fixation steps. The developer to be used in this case includes a two-component type developer composed of a toner and a carrier and a single-component type developer using a magnetic toner or a non-magnetic toner alone, and a production method of the toners is generally a kneading and milling production method carried out by melting and kneading a thermoplastic resin with a pigment, a charge control agent, and a releasing agent such as a wax, cooling the kneaded mixture, finely milling the mixture thereafter, and further classifying the milled powder. For the toners, if necessary, inorganic or organic particles for improving the fluidity and cleaning property may be added to the toner particle surfaces.

Recently, copying machines, printers employing color electrophotography and composite machines combining these and a facsimile machine have surprisingly been spread, but in the case where proper gloss in color image reproduction and high transparency to obtain excellent OHP images are to be accomplished, it is generally difficult to use a releasing agent such as a wax. Therefore, a large quantity of oil is applied to a fixing roll for assisting separation, and this leads to a result such that duplicated images including OHP have a sticky feeling and subsequent writing on the images with a pen or the like is difficult and also frequently causes uneven gloss. Waxes such as polyethylene, polypropylene, and paraffins to be used generally in common black-and-white copies are more difficult to use since they deteriorate OHP transparency.

On the other hand, even if the transparency is sacrificed, it is difficult to suppress exposure of waxes to the surface of the toners in the conventional toner production method employing the kneading and milling production method, and therefore, problems such as considerable fluidity deterioration and filming on a developing apparatus and a photoconductor are caused in the case where the toners are used as a developer.

As a method for rationally improving these problems, a production method is proposed employing a polymerization method carried out by dispersing an oil phase consisting of monomers as raw materials of a resin and a coloring agent in a water phase and directly polymerizing the monomers to obtain a toner, whereby waxes are enclosed in the toner and exposure of the waxes to the surface of the toner is suppressed.

Also, as means capable of intentionally controlling the toner shape and surface structure, a production method of a toner by an emulsion polymerization coagulation method is proposed (see, for example, Japanese Patent Application Laid-Open (JP-A) Nos. 63-282752 and 6-250439). These methods are production methods for obtaining a toner by producing a resin dispersion solution, generally by emulsion polymerization, and also producing a coloring agent dispersion solution containing a coloring agent dispersed in a solvent, mixing them, forming agglomerates corresponding to the toner particle diameter, and melting and uniting them by heating.

These production methods not only enclose waxes but also make the toners have a small diameter and thereby make clear and high-resolution image reproduction possible. However, to provide high quality images in the above-mentioned electrophotographic process and maintain stable properties of the toners under various mechanical stresses, it is very important to optimize the selection and the amounts of pigments and releasing agents, suppress exposure of the releasing agent to the surface, as well as improve gloss and releasing property in a state in which no fixing oil present and suppress hot offset by optimization of the resin characteristics.

On the other hand, to reduce energy consumption, techniques of fixation at lower temperature are desired, and particularly in recent years, to thoroughly save energy, it is desired to stop energization of a fixing apparatus at all times other than during use. Accordingly, it is necessary that the temperature of the fixation member of the fixation apparatus is increased instantaneously to the use temperature as soon as electricity is applied. Therefore, it is desirable to lessen the thermal capacity of the fixation member as much as possible, but in this case, the fluctuation amplitude of the temperature of the fixation member tends to become more significant than ever. That is, the overshoot of the temperature after starting the electric application becomes significant, and on the other hand, the temperature decrease owing to feeding of paper becomes significant. Also, in the case where paper with a width narrower than the width of the fixation member is continuously fed, the temperature difference becomes large between a paper-passing part and a paper-non-passing part. Particularly, in the case of using a toner for a high speed copying machine or a printer, the electric power capacity tends to be insufficient, and thus, the above-mentioned phenomenon tends to be caused easily. Accordingly, an electrophotographic toner which is to be fixed at a low temperature, causes no offset up to a high temperature range, and has a wide range of so-called fixation latitude has been desired strongly.

It is known that, as means for lowering a fixation temperature of a toner, a crystalline resin obtained by condensation polymerization and showing sharp melting behavior depending on temperature (hereinafter, a resin obtained by condensation polymerization is referred to as a condensation polymerization type resin) is employed as a binder resin composing a toner. However, the crystalline resin is difficult to crush by a melting, kneading, and milling method and therefore is, in general, not usable in many cases. Further, to polymerize the condensation polymerization type resin, reaction at a high temperature exceeding 200° C. and a considerably decreased pressure for no less than 10 hours under stirring with a high motive force is required, resulting in consumption of a large quantity of energy Therefore, in many cases, a huge investment in equipment is necessary to obtain durable reaction facilities.

On the other hand, in the case of carrying out a toner production method by an emulsion polymerization and coagulation method as described above, after polymerization, a condensation polymerization type crystalline resin may be emulsified to be latex and then coagulated with a pigment and a wax and then melted and united. However, at the time of emulsification of the condensation polymerization resin it is necessary to carry out very inefficient and energy-consuming steps of emulsifying the polymer by high shearing force under a high temperature exceeding 150° C., dissolving the polymer in a solvent, dispersing the obtained solution subjected to treatment for decreasing the viscosity in water, and then removing the solvent.

Meanwhile, it has been found that polymerization is made possible at a temperature of 100° C. or lower by a polymerization catalyst containing a rare earth element such as scandium (see, for example, Macromolecules, 36, 1772-17774 (2003)). However, with respect to the polyesters obtained by polymerization using an innovative polymerization catalyst, although the catalytic chemistry, mechanism, side reactions, and effects of the remaining catalyst are enthusiastically being investigated today, technical investigations regarding which characteristics should be controlled for practical applications have not been carried out sufficiently yet. Consequently, application of the resins to resins for toners have not been investigated sufficiently yet.

There is a report that condensation polymerization of polyesters in a water-based medium is possible (see, for example, U.S. Pat. No. 4,355,154). However, the polymerization mechanism of the technique is unclear with respect to many points, and it is difficult to obtain polymers with high molecular weights, and thus industrial practical application is still far away. Naturally, application of the polymerization technique of the polyesters to toners has not yet been investigated sufficiently, and even if the above-mentioned method is simply employed, it is thoroughly impossible to obtain sufficient strength, chargeability, environmental stability, and high-quality image properties as a toner.

As described above, there is no technique of producing a condensation polymerization type resin with a substantially low environmental load or a technique of applying the condensation polymerization type resin produced in water as a resin for a toner. Further, it is difficult to avoid a problem of hydrolysis at the time of emulsification of the condensation polymerization type resin in water, and not only has it been difficult to increase molecular weight of the resin, but also occurrence of unexpected issues in the material planning has been inevitable.

There has been no means made available to achieve the object of producing a toner containing a condensation polymerization type resin and consequently a toner having a small particle diameter with reduced production energy and cost so as to satisfy the demand of users in recent years for high quality images as printing or copying output.

SUMMARY OF THE INVENTION

The above-mentioned object can be accomplished by the following present invention. That is, the invention provides as follows.

<1> A toner for developing an electrostatic image containing toner particles obtained by forming coagulated particles by mixing a resin particle dispersion solution in which resin particles are dispersed and a coloring agent dispersion solution in which coloring agent particles are dispersed and fusing the coagulated particles by heating them and characterized in that the surfaces of the toner particles have a chemical structure formed by reaction with a compound having a carbodiimido group.

<2> The toner for developing an electrostatic image as described in <1>, in which the resin particles contain a crystalline resin obtained by polymerization of a condensation polymerizable monomer and having a melting point of at least 50° C. and less than 120° C.

<3> The toner for developing an electrostatic image as described in <2>, in which the crystalline resin is a crystalline polyester resin.

<4> The toner for developing an electrostatic image as described in <3>, in which the crystalline polyester resin is a polyester resin obtained by reaction of 1,9-nonanediol with 1,10-decamethylenedicarboxylic acid or by reaction of 1,6-hexanediol with sebacic acid.

<5> The toner for developing an electrostatic image as described in <1> to <4>, in which the resin particles contain a non-crystalline resin whose glass transition temperature Tg is 50° C. to 80° C.

<6> The toner for developing an electrostatic image as described in <1> to <5>, in which the compound having carbodiimido group is polycarbodiimide resin.

<7> The toner for developing an electrostatic image as described in <1> to <6>, in which the coagulated particles further contain releasing particles.

<8> A resin particle dispersion solution for a toner for developing an electrostatic image containing dispersed resin particles obtained by emulsifying or dispersing monomers including a condensation polymerizable monomer by mixing them in a water-based medium and condensation-polymerizing the mixed monomers and characterized in that the surfaces of the resin particles have a chemical structure formed by reaction with a compound having a carbodiimido group.

<9> The resin particle dispersion solution for a toner for developing an electrostatic image as described in <8>, in which the resin particles contain a crystalline resin obtained by polymerization of a condensation polymerizable monomer and having a melting point of at least 50° C. and less than 120° C.

<10> The resin particle dispersion solution for a toner for developing an electrostatic image as described in <8> and <9>, in which the volume average particle diameter of the resin particles in the resin particle dispersion solution is in a range of 0.05 to 2.0 μm.

<11> The resin particle dispersion solution for a toner for developing an electrostatic image as described in <8> to <10>, in which a catalyst to be used for the condensation polymerization is an acid having a surface activation effect.

<12> The resin particle dispersion solution for a toner for developing an electrostatic image as described in <11>, in which the acid having a surface activation effect is dodecylbenzenesulfonic acid, isopropylbenzenesulfonic acid, or camphersulfonic acid.

<13> The resin particle dispersion solution for a toner for developing an electrostatic image as described in <8> to <10>, in which a catalyst to be used for the condensation polymerization is a metal catalyst containing a rare earth element.

<14> The resin particle dispersion solution for a toner for developing an electrostatic image as described in <13>, in which the metal catalyst containing a rare earth element includes an alkylbenzene sulfonic acid salt, an alkylsulfuric acid ester salt, or a triflate structure.

<15> The resin particle dispersion solution for a toner for developing an electrostatic image as described in <8> to <10>, in which a catalyst to be used for the condensation polymerization is a hydrolyzing enzyme.

<16> The resin particle dispersion solution for a toner for developing an electrostatic image as described in <15>, in which the hydrolyzing enzyme is lipase.

DETAILED DESCRIPTION OF THE INVENTION

According to the present invention, owing to the above-mentioned constitution, not only a toner can efficiently be produced by using a condensation polymerization type resin but also both of a low temperature fixation property and an offset resistance property are remarkably improved and a high image quality can be maintained for a long duration.

Hereinafter, the invention will be described more in detail.

<Toner for Developing Electrostatic Image>

The toner for developing electrostatic image of the invention is a toner for developing electrostatic image containing toner particles obtained by forming coagulated particles by mixing a resin particle dispersion solution containing dispersed resin particles and a coloring agent dispersion solution containing dispersed coloring agent particles and fusing the coagulated particles by heating them and is characterized in that at least the surfaces of the toner particles have a chemical structure formed by reaction with a compound having a carbodiimido group.

Generally, in the synthesis of the condensation polymerization type resin, the polymerization is theoretically not promoted in water since it is accompanied with dehydration. However, in the case the condensation-polymerizable monomers are emulsified or dispersed in water together with a surfactant capable of forming micelle in water, the condensation-polymerizable monomers are put in hydrophobic fields in micro scale in the micelle and therefore the dehydration is caused and the produced water is discharged out of the micelle to promote the polymerization.

Use of the rare earth element-containing catalyst or a hydrolyzable enzyme having catalytic activity at a low temperature makes it possible to carry out condensation polymerization in emulsion state in normal pressure water at 100° C. or lower. Further, if a strong acid having a surface active effect represented by dodecylbenzenesulfonic acid is used, the condensation polymerization can be carried out in normal pressure water in a system having an emulsifying function and a catalytic function in combination without using the above-mentioned low temperature active catalyst.

Of course, to promote the polymerization fast and to use a large range of monomers, the condensation polymerization can be promoted in water under pressure at 100° C. or higher.

However, the weight average molecular weight of the polymers to be obtained by such polymerization methods tends to be at highest around 10,000 and in consideration of actual polymerization period, usually resins with a weight average molecular weight of 5,000 or lower tend to be obtained. In the case resins with such a low molecular weight are used for a binder resin of a toner, the mechanical strength sometimes becomes insufficient and problems on retention of image quality at the time of continuous operation tend to be caused easily owing to toner break and formation of agglomerated powder.

Particularly, with respect to a crystalline resin to be used for the low temperature fixation property, the resin is originally inferior in the strength to a non-crystalline resin and additionally there is another problem of difficulty to increase the molecular weight of the resins by the polymerization in water, and accordingly, many challenging problems are left while being unsolved to use the crystalline resin usable as a resin for a toner.

The inventors of the invention have made various investigations and consequently have found that the above problems could be solved by putting a compound having a carbodiimido group (hereinafter, referred to as a carbodiimide compound in some cases) among resin particles at the time of coagulation of the resin particles in an emulsion polymerization coagulation method or forming a chemical structure such as a crosslink structure by reaction with the carbodiimido group at the time of coagulation or fusion of particles.

The carbodiimide compound is a useful compound for graft modification of a condensation polymerization type resin such as a polyester and is characterized in that the compound is reacted with a carboxyl group or a hydroxyl group of a polyester resin to form a carbamoylamido group or an isourea bond and the reaction is promoted even in the presence of water and thus the compound is effective to increase the molecular weight of condensation polymerization type resin such as a polyester by graphitization or crosslinking.

In the invention, the inventors of the invention have noted the above-mentioned facts and particularly in a wet method of polymerization in water or toner particle formation, the inventors have found that resin particles could efficiently and effectively be bonded and toner particles having a firm surface structure could be obtained by using a carbodiamide compound is used.

A toner obtained by the above-mentioned manner is improved in the mechanical strength as compared with a conventional toner and particularly in the case, a crystalline resin such as a crystalline polyester is used as a binder resin for low temperature fixation, the use is effective to improve the strength of the toner particles themselves and efficient to prevent occurrence of filming at the time of continuous image formation and remarkably improve of the image quality retention.

With respect to not only the polyester resin but also an addition polymerization resin, the carbodiamide compound can form a bond with a carboxyl group of a copolymer produced using a monomer having the carboxyl group such as acrylic acid and accordingly improve the strength of the addition polymerization resin and thus makes it possible to form a composite with the polyester resin and addition polymerization resin.

The toner for developing electrostatic latent image of the invention can be produced by coagulating (associating) the resin particles in the resin particle dispersion solution with at least coloring agent particles (in the case a coloring agent is added previously in the resin in the polymerization step, the resin itself becomes the coloring agent particles) and fusing the coagulated particles.

Preferably, an emulsion polymerization coagulation method is employed for producing the toner particles. More particularly, the toner is obtained by coagulated particles with a toner diameter by mixing the resin particle dispersion solution produced by the invention with a coloring agent particle dispersion solution and a releasing agent particle dispersion solution and further adding a coagulant for causing hetero coagulation; fusing and uniting the coagulated particles by heating them at a temperature equal to or higher than the glass transition temperature or melting point of the resin particles; and successively washing and drying the obtained particles. In this production method, the toner shape can be controlled to be amorphous to spherical state by properly selecting the heating temperature condition.

(Resin Particle Dispersion Solution)

As the above-mentioned resin particles, resin particles of condensation polymerization type resin obtained mainly by condensation polymerization and resin particles of an addition polymerization type resin obtained by addition polymerization may be used. The resin particle dispersion solution of the addition polymerization resin can be produced by conventionally known emulsion polymerization.

On the other hand, it is preferable to add the condensation polymerization type resin to the resin particles to be the binder resin of the toner and the resin particle dispersion solution of the condensation polymerization type resin can be obtained by dispersion emulsification of a resin once obtained by bulk polymerization and from a viewpoint of lessening the environmental load, it is preferable to employ the following method of carrying out a condensation polymerization in water.

Hereinafter, mainly the resin particle dispersion solution of the above-mentioned condensation polymerization type resin will be described.

In the production of the resin particle dispersion solution of the condensation polymerization type resin, a step of condensation polymerization of monomers in water is included. In this case, the monomers are previously dispersed in a water-based medium, to which a small amount of a surfactant, a co-surfactant, or a polymerization initiator is added based on the necessity, by strong shearing force or ultrasonic and then heated and polymerized. If needed, the monomers are previously dissolved in another medium and further if needed, an oil phase containing a surfactant or a co-surfactant dissolved therein is formed and then, the monomers are dispersed in a water-based medium and polymerized by a similar technique as described above.

A polymerization method in this case may include general polymerization methods of particles in a water-based medium such as a suspension polymerization method; an emulsion polymerization method including an mini-emulsion method, a macro-emulsion method, a micro-emulsion method, a multi-step swelling method, and a seed polymerization method; and an expansive reaction method using a resin such as urethane resin which are carried out utilizing a common heterogeneous polymerization in a water-based medium. Among these polymerization methods, in terms of the easiness of obtaining a uniform particle diameter and narrow particle diameter distribution, the macro-emulsion method, the mini-emulsion polymerization method, and the micro-emulsion method are preferable to be employed and the mini-emulsion polymerization method is even more preferably to be selected.

Condensation-polymerizable monomers to be used for producing the resin particle dispersion solution of the condensation polymerization type resin are not particularly limited if they can be used for the above-mentioned various kinds of polymerization methods. The condensation-polymerizable monomers to be used in the invention are not particularly limited and may include aliphatic, alicyclic, and aromatic polycarboxylic acids and their alkyl esters and polyhydric alcohols and their esterified compounds and polyamines and polymerization may be carried out by direct esterification reaction or ester-interchange reaction.

The above-mentioned polycarboxylic acids are compounds having two or more carboxyl groups in one molecule. Dicarboxylic acids among them are compounds having two carboxyl groups in one molecule and examples are oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, malic acid, citric acid, hexahydroterephthalic acid, malonic acid, pimellic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenyl-p,p'-dicarboxylic acid, naphthalene-1,4-dicarboxylic acid, naphthalene-1,5-dicarboxylic acid, naphthalene-2,6-dicarboxylic acid, and anthracenedicarboxylic acid.

Polycarboxylic acids other than dicarboxylic acids may include trimellitic acid, pyromellitic acid, naphthalenetricarboxylic acid, napthalenetetracarboxylic acid, pyrenetricarboxylic acid, and pyrenetetracarboxylic acid.

In the case the polyester is produced by condensation polymerization in the invention, it is preferable to use azelaic acid, sebacic acid, 1,9-nonanedicarboxylic acid, 1,10-decamethylenedicarboxylic acid, 1,11-undecanedicarboxylic acid, 1,12-dodecanedicarboxylic acid, terephthalic acid, trimellitic acid, and pyromellitic acid among the polycarboxylic acids. Since these polycarboxylic acids are hardly soluble or insoluble in water, the condensation polymerization reaction is promoted in oil droplets formed by dispersion of the polycarboxylic acids in water.

The polyhydric alcohols to be used as condensation-polymerizable monomers to be used in the invention are compounds having two or more hydroxyl groups in one molecule. Dihydric polyols among them are compounds having two hydroxyl groups in one molecule and examples may include ethylene glycol, propylene glycol, butane diol, diethylene glycol, hexanediol, cyclohexanediol, octanediol, decanediol, and dodecanediol.

Polyols other than dihydric polyols are glycerin, pentaerythritol, hexamethylolmelamine, hexaethylolmeramine, tetramethylolbenzoguanamine, and tetraethylolbenzoguanamine.

In the case of producing the polyester by condensation polymerization in the invention, it is preferable to use dihydric polyols such as 1,8-octanediol, 1,10-decanediol, and 1,12-decanediol among the polyols.

Since these polyols are hardly soluble or insoluble in water, the condensation polymerization reaction is promoted in a suspension formed by dispersion of the polyols in water.

Also, the condensation polymerization may be carried out by using a substance containing a carboxyl group and a hydroxyl group in one molecule. Examples may include hydroxyoctanoic acid, hydroxynonanic acid, hydroxydecanoic acid, hydroxyundecanoic acid, hydorxydodecanoic acid, hydroxytetradecanoic acid, hydroxytridecanoic acid, hydroxyhexanoic acid, hydroxypentadecanoic acid, and hydroxystearic acid and examples are not limited to these compounds.

A non-crystalline resin and a crystalline resin can easily be obtained by combination of these condensation-polymerizable monomers. Crystalline polyesters and crystalline polyamides are preferable for them and crystalline polyesters are more preferable.

Preferable examples of diols to be used for obtaining the crystalline esters may also include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexane diol, 1,4-cyclohexanedimethanol, dipropylene glycol, polyethylene glycol, polypropylene glycol, polytetramethylene glycol, bisphenol A, bisphenol Z, and hydrogenated bisphenol A.

Preferable examples of diamines to be used for obtaining crystalline polyamides are ethylenediamine, diethylenediamine, triethylenediamine, 1,2-propylenediamine, 1,3-propylenediamine, 1,4-butanediamine, 1,4-butenediamine, 2,2-dimethyl-1,3-butanediamine, 1,5-pentanediamine, 1,6-hexanediamine, 1,4-cyclohexanediamine, and 1,4-cyclohexanedimethylamine.

Preferable examples of the dicarboxylic acids to be used for obtaining crystalline polyesters and crystalline polyamides are oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, and their anhydrides and chlorides.

Particularly preferable examples of the crystalline resins may include polyesters obtained by reaction of 1,9-nonanediol with 1,10-decamethylenedicarboxylic acid and cyclohexanediol with adipic acid; polyesters obtained by reaction of 1,6-hexanediol with sebacic acid; polyesters obtained by reaction of ethylene glycol and succinic acid; polyesters obtained by reaction of ethylene glycol with sebacic acid; and polyesters obtained by reaction of 1,4-butanediol and succinic acid.

Among them, even more preferable examples are polyesters obtained by reaction of 1,9-nonanediol with 1,10-decamethylenedicarboxylic acid and 1,6-hexanediol with sebacic achid.

Examples of a condensation polymerization catalyst to be use in the invention may include a surface activation type catalyst, a metal catalyst, and a hydrolyzing enzyme type catalyst.

Acids having a surface activation effect can be exemplified as the surface activation type catalyst and examples may include alkylbenzenesulfonic acids such as dodecylbenzenesulfonic acid, isopropylbenzenesulfonic acid, allylbenzenesulfonic acid, and camphorsulfonic acid; alkylsulfonic acid, alkyldisulfonic acid, alkylphenolsulfonic acid, alkylnaphthalenesulfonic acid, alkyltetralinsulfonic acid, alkylallylsulfonic acid, petroleum sulfonic acid, alkylbenzoimidazolesulfonic acid, higher alcohol ether sulfonic acid, alkyldiphenylsulfonic acid, monobutylphenylphenol sulfuric acid, dibutylphenylphenolsulfuric acid, higher fatty acid sulfuric acid ester such as dodecyl sulfate; higher alcohol sulfuric acid ester, higher alcohol ether sulfuric acid ester, higher fatty acid amide alkylol sulfuric acid ester, higher fatty acid amide alkylated sulfuric acid ester, naphthenyl alcohol sulfuric acid, sulfonated fat, sulfosuccinic acid ester, various kinds of fatty acids, sulfonated higher fatty acid, higher alkyl phosphoric acid ester, resin acid, resin acid alcohol sulfuric acid, naphthenic acid, niobic acid, and their salts, e.g. salts of the following rare earth metals, however the examples are not limited to these examples. A plurality of them may be used in combination.

Among them, as a preferably usable acid having the surface activation effect are exemplified dodecylbenzenesulfonic acid, isopropylbenzenesulfonic acid, and camphorsulfonic acid.

Examples of the above-mentioned metal catalyst are the following, however they are not limited to the following. For example, organic titanium compounds, organic tin compounds, organic halogenated tin compounds, and catalysts containing rare earth metals can be exemplified preferably.

Examples of rare earth metal-containing metal catalyst are those which contain lanthanides such as lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Particularly, their alkylbenzenesulfonic acid salts and alkylsulfuric acid ester salts, and those having triflate structure pare preferable.

The compounds defined by a structural formula: $X(OSO_2CF_3)_3$: are preferable as the above-mentioned metal triflates. In the formula, X denotes rare earth elements and among them, the metal triflates having the formula in which X is scandium (Sc), yttrium (Y), ytterbium (Yb) and samarium (Sm) are even more preferable.

As the rare earth metal-containing metal catalysts, lanthanide triflates are preferable. The lanthanide triflates are described in detail in Journal of Organic Synthetic Chemistry Associate, vol. 53, no. 5, pp. 44 to 54.

The above-mentioned hydrolyzing enzyme type catalyst (hydrolyzing catalyst) is not particularly limited if catalyzes the ester synthesis reaction.

Examples of the hydrolyzing enzyme are esterases classified to EC (enzyme number) 3.1 group (reference to Enzyme Handbook, Maruo & Tamiya, Asakura Shoten, 1982) such as carboxy esterase, lipase, phospholipase, acetyl esterase, pectin esterase, cholesterol esterase, tannase, monoacylglycerol lipase, lactonase, and lipoprotein lipase; hydrolyzing enzymes classified to EC 3.2 groups reactive on glycosyl compounds such as glycosidase, galactosidase, glucronidase, and xylosidase; hydrolyzing enzymes classified to EC 3.3 group such as epoxido hydrase; hydrolyzing enzymes classified to EC 3.4 group reactive on peptide bonds such as aminopeptitase, chymotrypsin, tripsin, plasmin, and subtilisin; and hydrolyzing enzymes classified to EC 3.7 group such as phloretin hydrase.

Among the above-mentioned esterases, the enzyme which hydrolyzes glycerol esters and isolates fatty acids is specially called as lipase and the lipase is advantageous in the stability in organic solvents, the catalysis of ester synthesis reaction at high yield, and the availability at a low cost. Accordingly, it is preferable to use lipase in terms of the yield and the cost in the production method of the condensation polymerization type resin of the invention.

Those which are derived from various origins can be used for the above-mentioned lipase and preferable lipase may include lipase obtained from microorganism such as *Pseudomonas, Alcaligenes, Achromobacter, Candida, Aspergillus, Rhizopus,* and *Mucor;* lipase obtained from plant seeds; lipase from animal tissues; as well as pancreatin and steapsin. Among them, lipase derived from microorganism such as *Pseudomonas, Candida,* and *Aspergillus* is preferable to be used.

These compounds having the catalytic function may be used alone or a plurality of them may be used in combination.

The addition amount of each catalyst is about 0.1 to 10,000 ppm in the condensation-polymerizable monomers and one or a plurality of the catalysts may be used.

Next, a method of producing resin particle dispersion solution of the condensation polymerization type resin will be described.

The production of the resin particle dispersion solution involves an emulsion or dispersion step of emulsifying or dispersing monomers including the condensation-polymerizable monomers in a water-based medium by mixing them and a polymerization step of forming resin particles by polymerization reaction.

In the emulsification or dispersion step, at the time of polymerization in the water-based medium, it is possible to previously mix a coloring agent, a releasing agent, and the like, which will be described later, in addition to the monomer components before the polymerization. Resin particles taking the coloring agent, the releasing agent (a wax), and the like therein can be produced by doing so.

In the emulsification or dispersion step, to keep the average particle diameter of the oil phase containing the condensation-polymerizable monomers in a specified range, a co-surfactant may be used in combination. The co-surfactant may be added so as to decrease the Ostwald ripening in so-called mini-emulsion polymerization.

In the invention, the content of the co-surfactant is preferably in a range of 0.1 to 40% by mass, more preferably in a range of 0.1 to 30% by mass, and even more preferably in a range of 0.1 to 20% by mass to the mixed monomers. If the content of the co-surfactant is lower than 0.1% by mass, the addition effect of the co-surfactant to the dispersion solution is decreased and the stability of the dispersion solution cannot be maintained and the dispersion droplet diameter is changed with the lapse of time and consequently, not only the latex particle diameter becomes large and the particle diameter distribution becomes wide but also the polymerization cannot be promoted sufficiently to result in that the molecular weight of the resin is decreased or the molecular weight distribution of the resin becomes wide in some cases. If the content exceeds 40% by mass, it becomes difficult to control the viscosity of the dispersion solution or the polymerization mechanism of the monomers is affected to make it sometimes impossible to sufficiently promote aimed condensation polymerization and other polymerization reaction of the monomers. Further, it sometimes causes an adverse effect on the fixation property and chargeability of the toner produced using the particle dispersion solution.

Examples usable as the co-surfactant are those which are commonly known as co-surfactants for a mini-emulsion method. Practical examples are alkanes having 8 to 30 carbons such as dodecane, hexadecane, and octadecane; alkyl alcohols having 8 to 30 carbons such as lauryl alcohol, cetyl alcohol, and stearyl alcohol; alkylthiols having 8 to 30 carbons such as lauryl mercaptan, cetyl mercaptan, and stearyl mercaptan; and acrylic acid esters, methacrylic acid esters, and their polymer; polymers or polyadducts such as polystyrene and polyester; carboxylic acids, ketones, and amines, however they are not limited these exemplified compounds.

With respect to the acrylic acid esters and methacrylic acid esters, alkyl groups having ester bonds with acrylic acid and methacrylic acid are preferable to have 5 or more carbon atoms. Examples are lauryl methacrylate, stearyl methacrylate, lauryl acrylate, and stearyl acrylate, however they are not limited to these exemplified compounds. Also, their homopolymers and copolymers can be exemplified, however examples are not limited to these polymers. The weight average molecular weight of these polymers is preferable to be less than 100,000.

In the case the co-surfactant is polyester, polyester used commonly can be used and condensation products of alcohols having 3 or more carbon atoms and polycarboxylic acids can be used. In this case, the molecular weight is preferably in a range of 2,000 to 100,000 on the basis of weight average molecular weight.

In the case the co-surfactant is polystyrene, the weight average molecular weight is preferable to be 100,000 or lower.

Among the above exemplified co-surfactants, those which are used preferably are hexadecane, cetyl alcohol, stearyl methacrylate, lauryl methacrylate, polyester, and polystyrene. For a purpose of avoiding production of volatile organic compounds, stearyl methacrylate, lauryl methacrylate, polyester, and polystyrene are more preferable.

The polymers and compositions containing the polymers usable as the above-mentioned co-surfactant may contain copolymers, block copolymers, and mixtures with other monomers may be contained. A plurality of co-surfactants may also be used in combination.

In the invention, the volume average particle diameter of the resin particles in the resin particle dispersion solution is preferably 0.05 to 2.0 μm, more preferably 0.1 to 1.5 μm, and even more preferably 0.1 to 1.0 μm. To obtain resin particles with the above-mentioned particle diameter, it is preferable to disperse the mixed monomers so as to keep the particle diameter in the range.

If the particle diameter is too small, the coagulation property at the time of granulation is worsened and isolated resin particles are easily formed and the viscosity of the system tends to be increased, resulting in difficulty of controllability of the particle diameter. On the other hand, if it is too large, coarse powder tends to be formed easily and the particle diameter distribution is worsened at the time of granulation and at the same time, the releasing agent such as a wax tends to be isolated easily to result in decrease of off-set occurrence temperature.

In the resin particle dispersion solution, it is very important that no ultra small powder or no ultra large powder is formed and the ratio of particles with a volume average particle diameter in a range of 0.01 to 5.0 μm is preferably 10% by number or less and more preferably 5% by number or less.

The volume average particle diameter of the resin particles can be measured by a laser diffraction particle size distribution measurement apparatus (LA-920, manufactured by Horiba Seisakusho).

In the emulsion/dispersion process, a particle emulsion is to be formed and to form the particle emulsion, a monomer solution containing a co-surfactant and an aqueous solution of a surfactant are evenly mixed and emulsified by a shear mixing apparatus such as a piston homogenizer, a microfluidization apparatus (e.g. Microfludizer, manufactured by Microflue Dix), and an ultrasonic dispersing apparatus. At that time, the supply amount of the monomers to water is adjusted to be about 0.1 to 50% by mass to the total of the monomers and water and the use amount of the surfactant is preferably less than the critical micelle concentration (CMC) in the presence of the emulsion and the use amount of the co-surfactant is preferably in a range of 0.1 to 40 part by mass and more preferably in a range of 0.1 to 10 part by mass to the monomers 100 part by mass.

Polymerization of the monomers of the monomer emulsion in the presence of the polymerization initiator by using a surfactant amount less than the critical micelle concentration (CMC) and a co-surfactant in combination is described in P. L. Tang, E. D. Sudol, C. A. Silebi, M. S. El-Aasser; J. Appl. Polymn. Sci., vol. 43, p. 1059 (1991) and known as so-called "mini-emulsion polymerization" and while conventional emulsion polymerization of a water-based emulsion of monomer particles with a particle diameter of about several μm by using a water-soluble polymerization initiator in the presence of a surfactant in an amount equal to or higher than the critical micelle concentration (CMC) is initiated by polymerization in the surfactant micelle and the polymer particles are grown by receiving monomers supplied from the monomer particles owing to dispersion, the "mini-emulsion polymerization" is carried out by polymerization of monomers in the monomer particles and therefore uniform polymer particles are formed by the "mini-emulsion polymerization" and further in the case of the "mini-emulsion polymerization" of polyester/vinyl compounded polymers like the invention, diffusion of the monomers is not needed in the polymerization process and the polymerization method of the invention has an advantage that the polyester can exist as it is in the polymer particles.

Further, so-called "micro-emulsion polymerization" of particles with a particle diameter of 5 to 50 nm described in J. S. Guo, M. S. El-Aasser, J. W. Vanderholl; J. Polym. Sci.: Polym. Chem. Ed., vol. 27, p. 691 (1989) has the dispersion structure and the polymerization mechanism similar to those of the "mini-emulsion polymerization" in the invention, however the "micro-emulsion polymerization" is carried out using a large amount of a surfactant in a concentration equal to or higher than the critical micelle concentration (CMC) and consequently there are problems that the obtained polymer particles are contaminated with a large quantity of the surfactant or that it takes a long time for water washing, acid washing, or alkali washing for removing the surfactant.

The above-mentioned polymerization step is carried out by heating the dispersion solution of the monomer particles emulsified or dispersed in the above-mentioned manner.

The condensation polymerization in the invention can be carried out at a temperature lower than that of conventional methods as described and the polymerization is preferable to be carried out in a range of 50 to 120° C.

The weight average molecular weight of the resin particles to be obtained by polymerization of the condensation-polymerizable monomers is preferably in a range of 1,500 to 60,000 and more preferably in a range of 3,000 to 40,000. If the weight average molecular weight is lower than 1,500, the coagulation force of a binder resin tends to be decreased and the off-set resistance property may be lowered in the case of using them for a toner. If it exceeds 60,000, although the off-set resistance is high, the lowest fixation temperature tends to become high.

The resin particles may have partially branched or crosslinked structure in accordance with the selection of the acidic value of the carboxylic acid and hydric value of the alcohol.

In the case the resin particles contain a crystalline resin, the melting point of the resin particles is preferably 50° C. or higher and lower than 120° C. and particularly preferably in a range of 55 to 90° C. If the melting point of the crystalline resin to be used is lower than 50° C., the blocking resistance of the toner becomes inferior and if it is 120° C. or higher, the melt fluidity of the toner at a low temperature is decreased and the fixation property may possibly be worsened.

In the case the resin particles are non-crystalline, the glass transition temperature Tg of the resin particles is preferably in a range of 50 to 80° C. and more preferably in a range of 50 to 65° C. If Tg is lower than 50° C., since the coagulation force of the binder resin itself is lowered in a high temperature range, hot off-set tends to occur easily at the time of fixation and if it exceeds 80° C., melting cannot be caused sufficiently and the lowest fixation temperature is increased.

The melting point and Tg of the resin particles can be measured by using, for example, DSC 50 (manufactured by Shimadzu Corp.) according to differential scanning calorimetry (DSC) and practically, they are measured by heating a sample about 10 mg at a constant heating speed (10° C./min) and the temperature at a crossing point of the base line and the extended line of a rising line is defined as Tg and the temperature at the top point of the heat absorption peak is defined as the melting point.

With respect to whether the resin has crystallinity or not, it is determined that the resin has crystallinity in the case the heat absorption curve measured by the above-mentioned method is in accordance with JIS K7121: 87 thawing temperature and the temperature difference between the crossing point (the thawing starting temperature) of the straight line drawn by extending the base line in the lower temperature side toward the higher temperature side and the tangent line drawn at the point where the inclination becomes the maximum in the curve of the thawing peak (a heat absorption peak) in the lower temperature side and the crossing point (the thawing finishing temperature) of the straight line drawn by extending the base line in the higher temperature side toward the lower temperature side and the tangent line drawn at the point where the inclination becomes the maximum in the curve of the thawing peak (a heat absorption peak) in the higher temperature side is within 50° C. and the curves similarly do not show steps defined in JIS K7121: 87.

(Compound Having Carbodiimido Group)

The carbodiimido compound to be used in the invention has a carbodiimido group in a molecule and can form a chemical structure of a carbamoylamido bond by reaction with a carboxyl group of a polyester resin or an isourea bond by reaction with a hydroxyl group of a polyester resin. Further, a guanidine structure formed in the case of reaction with an amino group is also included in the chemical structure. These chemical structures can be confirmed by measurement by an infrared absorption spectrum, particularly an FT-IR ATR (attenuated total reflection) method.

A polycarbodiimide resin is preferable to be used as the carbodiimido compound for the invention and the carbodiimide resin is obtained by decarbonation condensation reaction of an isocyanate compound as a raw material in the presence of a carbodiimidation catalyst such as 3-methyl-1-phenyl-2-phospholene oxide, 1-phenyl-2-phospholene-1-oxide, or the like at a reaction temperature of 120 to 150° C. in an aliphatic acetate type, halogen type, or alicyclic ether type solvent under pressurized state.

Examples of the isocyanate compound as the raw material for producing the polycarbodiimide resin are n-butyl isocyanate, tert-butyl diisocyanate, iso-butyl isocyanate, ethyl isocyanate, n-propyl isocyanate, iso-propyl isocyanate, cyclohexyl isocyanate, n-octadecyl isocyanate, 2,4-toluylene diisocyanate, 2,6-toluylene diisocyanate, o-tolidine diisocyanate, 4,4'-diphenylmethane diisocyanate, 4,4'-dicyclohexylmethane diisocyanate, 4,4'-diphenyl ether diisocyanate, 3,3'-dimethoxy-4,4'-biphenyl diisocyanate, p-phenylene diisocyanate, naphthylene-1,5-diisocyanate, m-xylylene diisocyanate, hydrogenated xylylene diisocyanate, m-tetramethylxylylene diisocyanate, p-tetramethylxylylene diisocyanate, hexamethylene diisocyanate, trimethylhexamethylene diisocyanate, and isophorone diisocyanate.

Examples of the polycarbodiimide resin obtained from the above-mentioned raw material are poly(tert-butylcarbodiimide), poly(tetramethylxylylene carbodiimide), poly(2,4-toluylene carbodiimide), poly(2,6-toluylene carbodiimide), poly(o-tolydine carbodiimide), poly(4,4'-diphenylmethane carbodiimide), poly(4,4'-dicyclohexylmethane carbodiimide), poly(4,4'-diphenyl ether carbodiimide), poly(3,3'-dimethoxy-4,4'-biphenyl carbodiimide), poly(p-phenylene carbodiimide), poly(naphthylene-1,5-carbodiimide), poly (m-xylylene carbodiimide), poly(hydrogenated xylylene carbodiimide), poly(hexamethylene carbodiimide), poly(trimethylhexamethylene carbodiimide), and poly(isophorone carbodiimide).

In this connection, as common commercialized products, Carbodilite E series (emulsion types) and V series (water-based types) manufactured by Nisshinbo Industries, Inc. are usable.

The reaction of the compound having a carbodiimido group and a resin having carboxyl or hydroxyl can be promoted by mixing and heating the carbodiimide compound and the resin particles in an emulsion polymerization and coagulation method, which will be described later, and in the case of a toner production method involving the coagulation and unification process, by keeping these raw material at a unification heating temperature. Further, as described below, the carbodiimide compound is previously added to resin particles (the resin particle dispersion solution for a toner for developing electrostatic image of the invention) and then the resin particles may be coagulated as they are and the reaction may be promoted at the time of unification.

In the invention, the addition amount of the carbodiimide compound for forming firm bonds among resin particles is preferably in a range of 0.01 to 20.0 part by mass and more preferably in a range of 0.1 to 15.0 part by mass in both cases that the compound is added internally to the resin particles and that the compound is added externally to the resin particles.

In the case of addition externally to the resin particles, the addition time may be before the coagulation step or after the coagulation step and before the fusing step.

In the coagulation step, it can be carried out by mixing a resin particle dispersion solution produced by a method other than the above-mentioned method (e.g. a common emulsion polymerization) and the resin particle dispersion solution produced by the above-mentioned method and then carrying out the steps after the coagulation step. At that time, it is also possible that the particles are made to have multi-layers by previously coagulating the resin particles of the condensation polymerization type resin for forming first coagulated particles and then adding the same resin particle dispersion solution or another resin particle dispersion solution for forming a second shell layer on the surfaces of the first particles. The multi-layered particles may be formed by carrying out the above-mentioned steps in the reverse order.

At the time of producing a toner using the resin particle dispersion solution of the above-mentioned condensation polymerization type resin, a resin particle dispersion solution of an addition polymerization type resin produced by conventionally known emulsion polymerization may be used together.

Examples of an addition polymerizable monomer for producing the resin particle dispersion solution are styrenes such as styrene, p-chlorostyrene; vinyl naphthalene, vinyl chloride, vinyl bromide, vinyl fluoride, vinyl esters such as vinyl acetate, vinyl propionate, vinyl benzoate, and vinyl butyrate; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate; acrylonitrile, methacrylonitrile, acrylamide, vinyl ethers such as vinyl methyl ether, vinyl ethyl ether, and vinyl isobutyl ether; and monomers having a N-containing polar group such as N-vinyl compounds, e.g. N-vinylpyrrole, N-vinylcarbazole, N-vinylindole, and N-vinylpyrrolidone; vinyl carboxylic acids such as methacrylic acid, acrylic acid, cinnamic acid, and carboxyethyl acrylate; and homopolymers and copolymers of these vinyl type monomers and various kinds of waxes may also be used in combination.

In the case of the addition polymerizable monomers, the resin particle dispersion solution can be produced by emulsion polymerization using an ionic surfactant and in the case of another resin, if the resin is dissolved in a solvent which is oil type and has relatively low solubility in water, the resin is dissolved in the solvent and dispersed in form of finely granular state in water together with an ionic surfactant and a polymer electrolytic substance in water by a dispersing apparatus such as a homogenizer and then the solvent is evaporated by heating or reducing the pressure to obtain the resin particle dispersion solution.

As a coagulant for the coagulation step, besides surfactants, inorganic salts and divalent metal salts are preferable to be used. Particularly, in the case of using a metal salt, metal salt use is preferable in terms of coagulation controllability and toner chargeability. Examples of the metal salts to be used for coagulation can be obtained by dissolving common inorganic metal compounds or their polymers in a resin particle dispersion solution and the metal elements composing the inorganic metal salts are those which belong to Group IIA, IIIA, IVA, VA, VIA, VIIA, VIII, IB, IIB, and IIIB in a periodic chart (a longer periodic chart), have di- or higher-valent electric charge; and are soluble in form of ions in the coagulation system of the resin particles.

Preferable examples of the inorganic metal salts are metals salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Among them, aluminum salts and their polymers are preferable. Generally, to obtain a sharper particle size distribution, the valence of the inorganic metal salts is more preferable to be divalent than monovalent and to be trivalent than divalent and in the case the valence is same, polymer type inorganic metal salts are more preferable.

With respect to a coloring agent to be used for a toner in the invention, as a black color pigment, carbon black, copper oxide, manganese dioxide, aniline black, activated carbon, non-magnetic ferrite, and magnetite can be exemplified.

As a yellow color pigment, chrome yellow, zinc yellow, yellow iron oxide, cadmium yellow, chromium yellow, Hansa Yellow, Hansa Yellow 10G, Benzidine Yellow G, Benzidine Yellow GR, Threne Yellow, Quinoline Yellow, Permanent Yellow NCG can be exemplified.

As an orange color pigment, red chrome yellow, Molybdenum Orange, Permanent Orange GTR, Pyrazolone Orange, Vulcan Orange, Benzidine Orange G, Indathrene Brilliant Orange RK, and Indathrene Brilliant Orange GK can be exemplified.

As a red color pigment, red iron oxide, Cadmium Red, red lead, mercury sulfide, Watchung Red, Permanent Red 4R, Lithol Red, Brilliant Carmine 3B, Du Pont Oil Red, Pyrazolone Red, Rhodamine B Lake, Lake Red C, Rose Bengal, Eosine Red, and Alizarine Lake can be exemplified.

As a blue color pigment, Prussian Blue, Cobalt Blue, Alkali Blue Lake, Victoria Blue Lake, Fast Sky Blue, Indathrenie Blue BC, Aniline Blue, Ultramarine Blue, Calco Oil Blue, Methylene Blue Chloride, Phthalocyanine Blue, Phthalocyanine Green, and Malachite Green Oxalate can be exemplified.

As a violet color pigment, Manganese Violet, Fast Violet B, and Methyl Violet Lake can be exemplified.

As a green color pigment, chromium oxide, Chrome Green, Pigment Green, Malachite Green Lake, and Final Yellow Green G can be exemplified.

As a white pigment, zinc flower, titanium oxide, antimony white, and zinc sulfide can be exemplified.

As an extender pigment, a barite powder, barium carbonate, clay, silica, white carbon, talc, and alumina white can be exemplified.

Also, as a dye, various kinds of dyes such as basic, acidic, dispersion, or direct dyes and examples are Nigrosine, Methylene Blue, Rose Bengal, Quinoline Yellow, and Ultra Marine Blue.

These coloring agents may be used alone or while being mixed. These coloring agents may be used for producing a coloring agent particle dispersion solution by using, for example, a rotary shear type homogenizer and a medium dispersion apparatus such as a ball mill, a sand mill and an attriter; and a high pressure counter collision type dispersion apparatus. Further, these coloring agents may be dispersed in a water-based system using a polar surfactant by a homogenizer.

The coloring agents should be selected in terms of the hue angle, chroma, lightness, weathering resistance, OHP transmittance, and dispersibility in the toner.

The coloring agents may be added in an amount in a range of 4 to 15% by mass to the total weight of the solid matters composing the toner. The addition amount of the coloring agents is a needed amount for assuring the coloration at the time of fixation.

The mean diameter (the volume average particle diameter) of the coloring agent particles in the toner is controlled in a range of 100 to 330 nm so as to assure the OHP transparency and coloration.

In the case of using the toner as a magnetic toner, a magnetic powder may be added. Practically, a substance to be magnetized in a magnetic field may be used and ferromagnetic powders of iron, cobalt, and nickel or compounds such as ferrite and magnetite may be used.

In the case the toner is obtained in water phase, the mobility of the magnetic material in water phase has to be carefully considered and preferably the surface of the magnetic material is previously reformed, for example, subjected to treatment for hydrophobicity. In the case of using a magnetic material as a black coloring agent, the material may be added in a range of 12 to 240% by mass, different from those in the case of using other coloring agent.

In the invention, one or a plurality of conventionally known additives may be added within a range of causing no effect on the invention may be added. For examples a flame retardant, a flame retarding aid, a brightener, a water-proofing agent, a water-repelling agent, an inorganic filler (surface-modifying agent), a releasing agent, an antioxidant, a plasticizer, a surfactant, a dispersing agent, a lubricant, a filler, an extender pigment, a binder, a charge controlling agent, an anti-bacterial agent, and the like. These additives may be added in production of any coating agent.

As an internal additive, various kinds of charge controlling agents such as quaternary ammonium salts and Nigrosine type compounds to be used conventionally as charge control agents may be used and in terms of stability and decrease of wastewater pollution at the time of production, materials hard to be dissolved in water are preferable.

Examples of the release agent may include various kinds of ester waxes, low molecular weight polyolefins such as polyethylene, polypropylene, and polybutene; silicones having a softening point by heating; fatty acid amides and ester waxes such as oleic acid amide, erucic acid amide, ricinoleic acid amide, and stearic acid amide; plant-derived waxes such as carnauba wax, rice wax, candelilla wax, Japan wax, and jojoba oil; animal-type waxes such as bee wax; mineral and petroleum type waxes such as montan wax, ozocerite, ceresine, paraffin wax, microcrystalline wax, Fisher-Tropsch wax, and their modified substances.

These waxes may be dispersed together with an ionic surfactant and a polymer electrolytic substance such as a polymer acid or a polymer base in water and granulated by a homogenizer or a pressure discharge type dispersing apparatus which can heat them at a melting temperature or higher and apply strong shearing force to obtain a dispersion solution of particles with 1 μm or smaller.

These releasing agents may be added in a range of 5 to 25% by mass in the total weight of solid matters composing the toner.

As the flame retardant and the flame retarding aid, conventionally widely used bromine type flame retardants, and antimony trioxide, magnesium hydroxide, aluminum hydroxide, ammonium polyphosphate can be exemplified, however they are not limited to these examples.

Similarly to a conventional toner, after drying, inorganic particles of silica, alumina, titania, calcium carbonate or the like or resin particles of vinyl type resins, polyesters, and silicones may be added to the surface in dry state by applying shearing force to use them as a fluidity assisting agent or cleaning assisting agent.

A surfactant may be used for dispersion of a pigment, dispersion of resin particles, dispersion of a releasing agent, the coagulation, and stabilization of coagulated particles. Practically, it is effective to use the following surfactants in combination: anionic surfactants such as sulfuric acid ester salts, sulfonic acid salts, phosphoric acid esters, and soaps; cationic surfactants amine salts and quaternary ammonium salts; and nonionic surfactants such as polyethylene glycols, alkylphenol ethylene oxide adducts, polyhydric alcohols and as dispersing means are used commonly employed means such as a rotary shear type homogenizer and a ball mill, a sand mill, and a dyno-mill.

On completion of the fusing and uniting step of the coagulated particles, a washing step, a solid-liquid separation step, and a drying step may optionally be carried out to obtain desired toner particles and in consideration of the chargeability, the washing step is desirable to be carried out thoroughly washing with ion-exchanged water. The solid-liquid separation step is not particularly limited, however in terms of the productivity, suction filtration and pressure filtration are preferable. Further, the drying step is also not particularly limited, however in terms of the productivity, freeze drying, flush jet drying, fluidization drying, and vibration fluidization drying are preferable to be employed.

The volume average particle diameter of the toner for developing electrostatic image of the invention obtained by the above-mentioned method is preferable to have a volume average particle diameter $D_{50V}$ in a range of 3.0 to 9.0 μm and preferably in a range of 3.0 to 5.0 μm. If $D_{50V}$ is smaller than 3.0 μm, the adhesion force is increased and the developability may possibly be deteriorated. If it exceeds 9.0 μm, the resolution of images may possibly be deteriorated.

The size distribution index GSDv of the volume average particle diameter of the obtained toner is preferably to be 1.30 or lower. If GSDv exceeds 1.3, the resolution is decreased and it may possibly lead to image defects such as toner scattering and fogging.

The volume average particle diameter $D_{50V}$ and the average particle size distribution index may be defined as follows: cumulative distribution curves by the volume and the number are drawn from the smaller diameter side in relation to the particle size range (channel) in the particle size distribution measured by Coulter Counter TAII (Beckman Coulter Inc.) and the particle diameter at which the cumulative volume becomes 16% is defined to be volume $D_{16V}$, the cumulative volume becomes 50% is defined to be volume $D_{50V}$, and the cumulative volume becomes 84% is defined to be volume $D_{84V}$. The volume average particle size distribution index (GSDv) can be calculated as $(D_{84V}/D_{50V})^{1/2}$.

The shape factor SF1 of the obtained toner is preferably in a range of 100 to 140 and more preferably in a range of 110 to 135 from a point of the image formability.

The above-mentioned shape factor SF1 can be calculated according to the following equation (1):

$$SF1=(ML^2/A)\times(\pi/4)\times 100 \quad \text{(equation (1))}$$

wherein ML represents the absolute maximum length of toner particles and A represents the projected surface area of a toner particle.

The above-mentioned SF1 can be numerated by analyzing microscopic images or scanning electron microscopic (SEM) images by an image analyzer and calculated as follows. That is, an optical microscopic image of a toner dispersed on the slide glass surface is taken in a Luzex image analyzer via a video camera and the maximum length of 100 or more toner particles and their projected surface areas are measured and calculation is carried out from the results according to the above-mentioned equation (1) and the average value is calculated.

For a purpose to provide fluidity and improve the cleaning property, similarly to a conventional toner, after drying, inorganic particles of silica, alumina, titania, calcium carbonate or the like or resin particles of vinyl type resins, polyesters, and silicones may be added to the surfaces of the toner particles in dry state by applying shearing force.

In the case particles are stuck to the toner surfaces in a water-based medium, any kinds of externally added agents to be used conventionally for the toner surface such as silica, alumina, titania, calcium carbonate, magnesium carbonate, and tricalcium phosphate can be used while being dispersed by an ionic surfactant, a polymer acid, or a polymer base.

<Resin Particle Dispersion Solution for Toner for Developing Electrostatic Image>

A resin particle dispersion solution for a toner for developing electrostatic image of the invention is a resin particle dispersion solution for a toner for developing electrostatic image containing dispersed resin particles obtained by emulsifying or dispersing monomers including at least a condensation polymerizable monomer by mixing them in a water-based medium and condensation-polymerizing the mixed monomers and characterized in that a compound having a carbodiimido group is contained in at least the surfaces of the toner particles.

The resin particle dispersion solution for a toner for developing electrostatic image is preferably used for production of the toner of the invention. That is, the toner of the invention contains the resin particles having firm bonds of a chemical structure formed by reaction with the carbodiimide group through the carbodiimide compound and at the time of production of the toner particles, if the resin particles containing the carbodiimido group-containing compound in the surface, the toner can easily be obtained by coagulating (in some cases adding a carbodiimide compound additionally) the resin particles as they are in the coagulation step and melting them.

The resin particle dispersion solution of a toner for developing electrostatic image can be obtained by adding the carbodiimide compound together with the condensation-polymerizable monomers and polymerizing them at the time of producing the resin particle dispersion solution using the condensation-polymerizable monomers described in the explanation of the toner of the invention.

In this case, at the time of polymerization, to keep the carbodiamide compound existing in the resin particle surfaces as much as possible without causing reaction of the carbodiimido group, it is preferable to add the compound having the carbodiimido group in the resin particle dispersion solution and heat the dispersion at a temperature in a range of a normal temperature to 80° C. or preferably at a temperature in a range of, 30° C. to 70° C. for several hours, preferably 1 to 3 hours. If the treatment temperature exceeds 80° C., the carbodiimido group may possibly be reacted completely and the melting to be carried out in the coagulation and unification steps thereafter is carried out insufficiently and therefore, it is very important to carry out the treatment at a reactively low temperature.

The carbodiimido group exists in the resin particle surfaces in the resin particle dispersion solution produced in the above-mentioned manner and the existence state can be confirmed by measurement by an infrared absorption spectrum, particularly an FT-IR ATR (attenuated total reflection) method.

The resin particles are preferable to contain a crystalline resin having a melting point as described above and as a catalyst to be used for condensation polymerization, an acid having the surface activation effect, a metal catalyst containing a rare earth element, and a hydrolyzing enzyme as described above can be used. The preferable particle diameter range and particle shape of the resin particles in the resin particle dispersion solution are also same as described above.

The toner for developing electrostatic image of the invention described above-mentioned can be used for an electrostatic developer. The developer is not particularly limited except that it contains the toner for developing electrostatic image and may have proper component composition in accordance with the uses. If the toner for developing electrostatic image is used alone, it is produced in form of a mono-component electrostatic developer and if it is used in combination with a carrier, it is produced in form of a two-component type electrostatic developer.

The carrier is not particularly limited and conventionally known carriers can be exemplified and carriers such as resin-coated carriers described in Japanese Patent Application Laid-Open Nos. 62-39879 and 56-11461 can be used.

In this connection, the mixing ratio of the toner and the carrier in the electrostatic developer is not particularly limited and may properly be selected in accordance with the uses.

The above-mentioned electrostatic developer (toner for developing electrostatic image) can be used for common image formation method in an electrostatic image development manner (electrophotographic manner). The image formation method practically involves, for example, steps of forming an electrostatic latent image, forming a toner image, transferring, fixing the toner image and cleaning the image. The respective steps are general steps to be carried out and described in Japanese Patent Application Laid-Open Nos. 56-40868 and 49-91231.

EXAMPLE

Hereinafter, the present invention and objects and features thereof will be more readily apparent from the following detailed description along with Examples. However, it is not intended that the invention be limited to the illustrated Examples or Comparative Examples. Hereinafter, "part" and "%" mean "part by mass" and "% by mass", respectively, without otherwise specified.

<Measurement Methods of Various Properties>

At first, measurement methods of the physical properties of the toners used in Examples and Comparative Examples will be described.

(Measurement Method of Toner Particle Size and Particle Size Distribution)

Measurement of the toner particle size and particle size distribution in the invention is carried out using a Coulter Counter TA-II model (manufactured by Beckman Coulter Inc.) as a measurement apparatus and ISOTON-II (manufactured by Beckman Coulter Inc.) as an electrolytic solution.

The measurement method is carried out as follows. A measurement sample of 0.5 to 50 mg is added to an aqueous solution containing 5% of a surfactant, preferably an alkylbenzenesulfonic acid sodium salt, of 2 ml and then the resulting solution is added to the above-mentioned electrolytic solution of 100 to 150 ml. The electrolytic solution in which the sample is suspended is subjected to dispersion for about 1 minute by a ultrasonic dispersing apparatus and the particle size distribution of particles to 2 to 60 μm is measured by employing an aperture with an aperture diameter of 100 μm by the above-mentioned Coulter Counter TA-II model and the volume average particle diameter and GSDv are measured as described above. The number of the particles to be measured is 50,000.

(Method for Measuring Molecular Weight of Resin and Molecular Weight Distribution)

In the invention, the weight average molecular weight Mw and number average molecular weight Mn are measured by the following method. That is, the weight average molecular weight Mw and number average molecular weight Mn are measured under the following conditions by gel permeation chromatography (GPC).

A solvent (tetrahydrofuran) is passed at a flow speed of 1.2 ml/min at 40° C. of temperature and a tetrahydrofuran sample solution with a 0.2 g/20 ml concentration, 3 mg as sample mass, is added and measurement is carried out.

At the time of molecular weight measurement of a sample, measurement conditions are selected in a manner that the molecular weight of the sample is included in a straight line between the logarithms and the counts of the molecular weights of a calibration curve produced using several kinds of polystyrene standardized samples of a mono-disperse system.

The reliability of the measurement results can be conformed based on the fact that an NBS706 polystyrene standardized sample is found having a weight average molecular weight $Mw=28.8\times10^4$ and a number average molecular weight $Mn=13.7\times10^4$ by the above-mentioned measurement method. GPC columns to be used may be any columns if they can satisfy the above-mentioned conditions. Practically, TSK-GEL, GMH, and the like (manufactured by Toyo Soda Manufacturing Co., Ltd.) may be used. Also, the solvent and the measurement temperature are not limited those exemplified above and may properly be changed.

(Volume Average Particle Diameters of Resin Particles and Coloring Agent Particles)

The volume average particle diameters of resin particles and coloring agent particles are measured by a laser diffractive particle size distribution measurement apparatus (LA-920, manufactured by Horiba Seisakusho).

(Measurement Method of Melting Point and Glass Transition Temperature of Resin)

The glass transition temperature (Tg) of a non-crystalline resin and the melting point (Tm) of a crystalline resin are measured by heating at temperature increase speed of 10° C./min from a room temperature to 150° C. using a differential scanning calorimeter (DSC 50, manufactured by Shimadzu Corp.). The glass transition temperature is defined as the temperature at a crossing point of the base line and the extended line of a rising line in the heat absorption part and the melting point is defined as the temperature at the top point of the heat absorption peak.

<Production of Resin Particle Dispersion Solution>

The resin particle dispersion solutions (1) to (10) are produced as follows. The resin particle dispersion solution (10) is a resin particle dispersion solution for a toner for developing electrostatic image of the invention.

(Resin Particle Dispersion Solution (1))

A uniform solution is produced by mixing:

| | | |
|---|---|---|
| dodecylbenzenesulfonic acid | 36 | part; and |
| ion-exchanged water | 1,000 | part. |
| 1,9-nonanediol | 80 | part and |
| 1,10-decamethylenedicarboxylic acid | 115 | part |

are mixed and heated at 120° C. for melting and added to the above obtained dodecylbenzenesulfonic acid solution and emulsified for 5 minutes by a homogenizer (ULTRA TURRAX T50, manufactured by IKA Japan, K.K.) and successively emulsified for 5 minutes in an ultrasonic bath and the obtained emulsion is kept at 70° C. in a flask for 12 hours while being stirred.

Accordingly, a resin particle dispersion solution (1) in which crystalline polyester particles with a volume average particle diameter of 440 nm, a melting point of 69° C., a weight average molecular weight 4,900, and a solid content of 18% are dispersed is obtained.

(Resin Particle Dispersion Solution (2))

A uniform solution is produced by mixing:

| | | |
|---|---|---|
| dodecylbenzenesulfonic acid | 36 | part; and |
| ion-exchanged water | 1,000 | part. |
| 1,6-hexanediol | 59 | part and |
| sebacic acid | 101 | part |

are mixed and heated at 140° C. for melting and added to the above obtained dodecylbenzenesulfonic acid solution and emulsified for 5 minutes by a homogenizer (ULTRA TURRAX T50, manufactured by IKA Japan, K.K.) and successively emulsified for 5 minutes in an ultrasonic bath and the obtained emulsion is kept at 70° C. in a flask for 12 hours while being stilted.

Accordingly, a resin particle dispersion solution (2) in which crystalline polyester particles with a volume average particle diameter of 820 nm, a melting point of 68° C., a weight average molecular weight 4,050, and a solid content of 16% are dispersed is obtained.

(Resin Particle Dispersion Solution (3))

A uniform solution is produced by mixing:

| | | |
|---|---|---|
| dodecyl sulfate | 30 | part; and |
| ion-exchanged water | 1,000 | part. |
| 1,9-nonanediol | 80 | part and |
| azelaic acid | 94 | part |

are mixed and heated at 110° C. for melting and added to the above obtained dodecyl sulfate solution and emulsified for 5 minutes by a homogenizer (ULTRA TURRAX T50, manufactured by IKA Japan, K.K.) and successively emulsified for 5 minutes in an ultrasonic bath and the obtained emulsion is kept at 70° C. in a flask for 12 hours while being stirred.

Accordingly, a resin particle dispersion solution (3) in which crystalline polyester particles with a volume average particle diameter of 310 nm, a melting point of 53° C., a weight average molecular weight 3,200, and a solid content of 17% are dispersed is obtained.

(Resin Particle Dispersion Solution (4))

A uniform solution is produced by mixing:

| | |
|---|---|
| scandium dodecyl sulfate | 36 part; and |
| ion-exchanged water | 1,000 part. |
| 1,9-nonanediol | 80 part and |
| 1,10-decamethylenedicarboxylic acid | 115 part |

are mixed and heated at 120° C. for melting and added to the above obtained scandium dodecyl sulfate solution and emulsified for 5 minutes by a homogenizer (ULTRA TURRAX T50, manufactured by IKA Japan, K.K.) and successively emulsified for 5 minutes in an ultrasonic bath and the obtained emulsion is kept at 80° C. in a flask for 12 hours while being stirred.

Accordingly, a resin particle dispersion solution (4) in which crystalline polyester particles with a volume average particle diameter of 420 nm, a melting point of 70° C., a weight average molecular weight 3,100, and a solid content of 18% are dispersed is obtained.

(Resin Particle Dispersion Solution (5))

A uniform solution is produced by mixing:

| | |
|---|---|
| dodecylbenzene sulfonic acid | 12 part; and |
| ion-exchanged water | 1,000 part. |
| lipase (derived from *Pseudomonas*) | 50 part, |
| 1,9-nonanediol | 80 part, and |
| 1,10-decamethylenedicarboxylic acid | 115 part |

are mixed and heated at 120° C. for melting and added to the above obtained dodecylbenzenesulfonic acid solution and emulsified for 5 minutes by a homogenizer (ULTRA TURRAX T50, manufactured by IKA Japan, K.K.) and the obtained emulsion is kept at 80° C. in a flask for 12 hours while being stirred.

Accordingly, a resin particle dispersion solution (5) in which crystalline polyester particles with a volume average particle diameter of 1,150 nm, a melting point of 69° C., a weight average molecular weight 3,800, and a solid content of 20% are dispersed is obtained.

(Resin Particle Dispersion Solution (6))

A uniform solution is produced by mixing:

| | |
|---|---|
| dodecylbenzene sulfonic acid | 36 part; and |
| ion-exchanged water | 1,000 part. |
| 1,4-butanediol | 45 part and |
| azelaic acid | 94 part |

are mixed and heated at 110° C. for melting and added to the above obtained dodecylbenzenesulfonic acid solution and emulsified for 5 minutes by a homogenizer (ULTRA TURRAX T50, manufactured by IKA Japan, K.K.) and successively emulsified for 5 minutes in an ultrasonic bath and the obtained emulsion is kept at 70° C. in a flask for 12 hours while being stirred.

Accordingly, a resin particle dispersion solution (6) in which crystalline polyester particles with a volume average particle diameter of 250 nm, a melting point of 48° C., a weight average molecular weight 3,500, and a solid content of 15% are dispersed is obtained.

(Resin Particle Dispersion Solution (7))

A uniform solution is produced by mixing:

| | |
|---|---|
| dodecylbenzene sulfonic acid | 18 part; and |
| ion-exchanged water | 1,000 part. |
| 1,9-nonanediol | 80 part and |
| 1,10-decamethylenedicarboxylic acid | 115 part |

are mixed and heated at 120° C. for melting and kept for 5 minutes after melting and added to the above obtained dodecylbenzenesulfonic acid solution and emulsified for 1 minute by a homogenizer (ULTRA TURRAX T50, manufactured by IKA Japan, K.K.) and the obtained emulsion is kept at 60° C. in a flask for 15 hours while being stirred.

Accordingly, a resin particle dispersion solution (7) in which crystalline polyester particles with a volume average particle diameter of 2,100 nm, a melting point of 69° C., a weight average molecular weight 3,500, and a solid content of 18% are dispersed is obtained.

(Resin Particle Dispersion Solution (8))

A solution is produced by mixing and dissolving the following components:

| | |
|---|---|
| styrene | 460 part; |
| n-butyl acrylate | 140 part; |
| acrylic acid | 12 part; and |
| dodecanethiol | 9 part. |

On the other hand, an anionic surfactant (Dowfax, manufactured by Dow Chemical Co.) of 12 part is dissolved in ion-exchanged water of 250 part and the above obtained solution is added to disperse and emulsify the components in a flask (a monomer emulsion solution A). Further, similarly, the anionic surfactant (Dowfax, manufactured by Dow Chemical Co.) of 1 part is dissolved in ion-exchanged water of 555 part and loaded into a flask for polymerization. Next, the flask for polymerization is tightly plugged and a refluxing tube is installed and while nitrogen is injected, the resulting flask for polymerization is heated to 75° C. in a water bath and held at the temperature under a condition of moderate stirring.

Ammonium persulfate of 9 parts is dissolved in ion-exchanged water of 43 parts and the obtained solution is dropwise added by a quantitative pump to the flask for polymerization for 20 minutes and then the monomer emulsion solution A is also slowly titrated by the quantitative pump for 200 minutes.

After that, while stirring is slowly continued, the flask for polymerization is heated to 75° C. and kept for 3 hours to finish the polymerization.

Accordingly, an anionic resin particle dispersion solution (8) containing particles with a volume average particle diameter of 210 nm, a glass transition point of 53.5° C., a weight average molecular weight 31,000, and a solid content of 42% is obtained.

(Resin Particle Dispersion Solution (9))

A solution is produced by mixing and dissolving the following components:

| | |
|---|---|
| styrene | 480 part; |
| n-butyl acrylate | 160 part; |
| carboxyethyl acrylate | 12 part; and |
| dodecanethiol | 9 part. |

On the other hand, an anionic surfactant (Dowfax, manufactured by Dow Chemical Co.) of 12 part is dissolved in ion-exchanged water of 250 part and the above obtained solution is added to disperse and emulsify the components in a flask (a monomer emulsion solution B). Further, similarly, the anionic surfactant (Dowfax, manufactured by Dow Chemical Co.) of 1 part is dissolved in ion-exchanged water of 555 part and loaded into a flask for polymerization. Next, the flask for polymerization is tightly plugged and a refluxing tube is installed and while nitrogen is injected, the resulting flask for polymerization is heated to 75° C. in a water bath and held at the temperature under a condition of moderate stirring.

Ammonium persulfate of 9 parts is dissolved in ion-exchanged water of 43 parts and the obtained solution is dropwise added by a quantitative pump to the flask for polymerization for 20 minutes and then the monomer emulsion solution B is also slowly titrated by the quantitative pump for 200 minutes.

After that, while stirring is slowly continued, the flask for polymerization is heated to 75° C. and kept for 3 hours to finish the polymerization.

Accordingly, an anionic resin particle dispersion solution (9) containing particles with a volume average particle diameter of 190 nm, a glass transition point of 55.0° C., a weight average molecular weight 29,000, and a solid content of 42% is obtained.

(Resin Particle Dispersion Solution (10))

A carbodiamide compound (Carbodilite VO2L2, manufactured by Nisshinbo Industries, Inc.) of 10 part is added to the resin particle dispersion solution (1) of 283 part and kept at 50° C. for 1 hour to canny out surface treatment of the resin particle surfaces.

Accordingly, a resin particle dispersion solution (10) in which crystalline polyester particles with a volume average particle diameter of 440 nm, a melting point of 69° C., a weight average molecular weight 6,100, and a solid content of 20% are dispersed is obtained.

After the resin particles in the resin particle dispersion solution are dried and subjected to the infrared absorption spectrometry to find existence of carbodiimido group in the surfaces.

The properties of the respective resin particle dispersion solutions are collectively shown in Table 1.

TABLE 1

| | Resin particle dispersion solution | | | | | | | | | |
|---|---|---|---|---|---|---|---|---|---|---|
| | (1) | (2) | (3) | (4) | (5) | (6) | (7) | (8) | (9) | (10) |
| Volume average particle diameter (μm) | 440 | 820 | 310 | 420 | 1150 | 250 | 2100 | 210 | 190 | 440 |
| Melting point (° C.) | 69 | 68 | 53 | 70 | 69 | 48 | 69 | — | — | 69 |
| Tg (° C.) | — | — | — | — | — | — | — | 53.5 | 55.0 | — |
| Mw | 4900 | 4050 | 3200 | 3100 | 3800 | 3500 | 3500 | 31000 | 29000 | 6100 |
| Solid content (%) | 18 | 16 | 17 | 18 | 20 | 15 | 18 | 42 | 42 | 20 |

<Production of Coloring Agent Dispersion Solution>

(Coloring Agent Dispersion Solution (1))

| | |
|---|---|
| Yellow color pigment (C.I. Pigment Yellow 74, manufactured by Dainichiseika Color & Chemicals Mfg. Co., Ltd.) | 50 part |
| Anionic surfactant (Neogen R, manufactured by Dai-Ichi Kogyo Seiyaku Co., Ltd.) | 5 part |
| ion-exchanged water | 200 part |

The above components are mixed and dissolved and dispersed for 5 minutes by a homogenizer (ULTRA TURRAX T50, manufactured by IKA Japan, K.K.) and successively dispersed for 10 minutes in an ultrasonic bath to obtain a yellow coloring agent dispersion solution (1) having a volume average particle diameter of 240 nm and a solid content of 21.5%.

(Coloring Agent Dispersion Solution (2))

A cyan coloring agent dispersion solution (2) having a volume average particle diameter of 190 nm and a solid content of 21.5% is obtained by the production method same as the production method of the coloring agent dispersion solution (1), except that Cyan pigment (C.I. Pigment Blue 15:3, copper phthalocyanine, manufactured by Dainichiseika Color & Chemicals Mfg. Co., Ltd.) is used in place of the Yellow pigment.

(Coloring Agent Dispersion Solution (3))

A magenta coloring agent dispersion solution (3) having a volume average particle diameter of 165 nm and a solid content of 21.5% is obtained by the production method same as the production method of the coloring agent dispersion solution (1), except that Magenta pigment (C.I. Pigment Red 122, manufactured by Dainichiseika Color & Chemicals Mfg. Co., Ltd.) is used in place of the Yellow pigment.

(Coloring Agent Dispersion Solution (4))

A black coloring agent dispersion solution (5) having a volume average particle diameter of 170 nm and a solid content of 21.5% is obtained by the production method same as the production method of the coloring agent dispersion solution (1), except that Black pigment (Carbon black, manufactured by Cabot Corp.) is used in place of the Yellow pigment.

<Production of Releasing Agent Dispersion Solution>

| | |
|---|---|
| Paraffin wax (HNP 9, melting point: 70° C., manufactured by Nippon Seiro Co., Ltd.) | 50 part |

-continued

| | |
|---|---|
| Anionic surfactant (Dowfax, manufactured by Dow Chemical Co.) | 5 part |
| ion-exchanged water | 200 part |

The above components are heated to 95° C. and sufficiently dispersed by a homogenizer (ULTRA TURRAX T50, manufactured by IKA Japan, K.K.) and successively dispersed by a pressure discharging homogenizer (Golin Homogenizer; manufactured by Golin Co.) to obtain a releasing agent dispersion solution having a volume average particle diameter of 180 nm and a solid content of 21.5%.

Example 1

| | |
|---|---|
| Resin particle dispersion solution (1) | 233 part (resin component 42 part) |
| Resin particle dispersion solution (8) | 50 part (resin component 21 part) |
| Carbodiimide compound (Carbodilite VO2L2, manufactured by Nisshinbo Industries, Inc.) | 10 part |
| Coloring agent dispersion solution (1) | 40 part (pigment 8.5 part) |
| Releasing agent dispersion solution | 40 part (releasing agent 8.6 part) |
| polyaluminum chloride | 0.15 part |
| ion-exchanged water | 300 part |

The above-mentioned carbodiimide compound is a water-soluble resin obtained by adding a hydrophilic structural group to a polycarbodiimido resin having a carbodiimido group defined as —N═C═N— and the solid content is 40%.

The resin particle dispersion solutions (1) and (8) and the carbodiimide compound among the above-mentioned components are heated at 60° C. for 2 hours and then cooled and together with other components, the resulting mixture is put in a round type flask made of a stainless steel and sufficiently mixed and dispersed by a homogenizer (ULTRA TURRAX T50, manufactured by IKA Japan, K.K.) and while the contents of the flask are stirred in an oil bath for heating, the contents are heated to 42° C. and kept at 42° C. for 60 minutes and then the resin particle dispersion solution (1) of 50 part (resin component 9 part) is additionally added and stirred moderately. After that, the pH of the reaction system is adjusted to be 6.0 by an aqueous solution of 0.5 mol/L sodium hydroxide and the resulting mixture is heated at 95° C. while being stirred.

During the heating to 95° C., in general, the pH of the reaction system is decreased to 5.0 or lower, however in this case, the aqueous sodium hydroxide solution is additionally titrated so as to prevent decrease of pH to lower than 5.5. On completion of the reaction, the reaction product is cooled and filtered and sufficiently washed with ion-exchanged water and then, the product is solid-liquid separated by Nutsche type suction filtration. The product is again dispersed in ion-exchanged water of 3 L at 40° C. and stirred at 300 rpm for 15 minutes and washed. The washing process is repeated 5 times and solid-liquid separation is carried out by Nutsche type suction filtration and then vacuum drying is carried out for 12 hours to obtain toner particles.

The particle diameter of the toner particles is measured by a Coulter counter to find that the volume average particle diameter $D_{50v}$ is 4.50 μm and the size distribution index GSDv of the volume average particle is 1.22. The toner particle shape SF1 measured by shape observation by a Luzex image analyzer is 131 and the shape is like a potato. It is confirmed by the infrared ray spectrometry of the toner particles that carbamoylamido bonds exist in the surfaces.

(Production of Toner and Developer)

A toner with external additives is obtained by adding a hydrophobic silica (TS720, manufactured by Cabot Corp.) of 1.2 part is mixed with the above-mentioned toner particles of 50 part by a sample mill.

A ferrite carrier coated with 1% coating of poly(methyl methacrylate) (manufactured by Soken Chemical Engineering Co., Ltd.) and having a volume average particle diameter of 50 μm is used and the externally-mixed toner is weighed and both are stirred and mixed for 5 minutes by a ball mill while the toner concentration is adjusted to be 5% to produce a developer.

(Evaluation of Toner)

-Lowest Fixation Temperature-

The fixation property of the toner is investigated by using above-mentioned developer and J coated paper manufactured by Fuji Xerox Co., Ltd. as transfer paper at a process speed of 180 mm/sec by an apparatus of DocuCenter Color 500 manufactured by Fuji Xerox Co., Ltd. reformed so as to be temperature-changeable. Practically, the fixation set temperature is increased by 5° C. in steps in a range of 90 to 200° C. and the image formation is repeated and the formed fixed images are subjected rubbing with a cloth and the lowest set temperature at which sufficient rubbing resistance is achieved is defined to be the lowest fixation temperature.

In this connection, a fixation roll used comprises a PFA tube as a surface layer and the fixation apparatus is an oilless type one.

-Off-Set Occurrence Temperature-

The measurement of the off-set occurrence temperature is similar to the measurement of the lowest fixation temperature and practically carried out by repeating image formation at the respectively set temperatures using a chart having an image part only at the tip end part in the image proceeding direction by the above-mentioned image formation apparatus, observing whether stains in white portions of the image owing to the off-set of the image at the tip end part by eye observation, and determining the lowest set temperature at which the stains of the toner are caused to be the off-set occurrence temperature.

In this connection, 200 or higher means that no off-set occurrence is observed at 200° C.

-Image Quality-

The image quality property is determined according to the following standard by measuring the thin line reproducibility of the fixed image of thin lines and the fogging (eye observation) of the non-fixed parts using a magnifying lens.

G1: neither unevenness of thin lines nor fogging

G2: unevenness and fogging are slightly observed when the image quality is carefully observed G3: the image quality is slightly uneven G4: the image quality is uneven -Evaluation of Image Quality Retention- The image quality retention is evaluated according to the following determination standards by carrying out a continuous operation-on-100,000 sheet test by a blade cleaning test using the above-mentioned modified DocuCenter Color 500.

G1: The good image quality of the initial period is completely maintained.

G2: The image quality is maintained well although slightly changed.

G3: There are image defects, however they are allowable.

G4: Image defects are observed and there is a problem in terms of the image quality (e.g. stains, streaks and the like on the background are formed owing to cleaning failure or filming of a photoconductor).

The evaluation results are collectively shown in Table 2.

Example 2

Toner particles are obtained in the same manner as Example 1, except that the resin particle dispersion solution (2) (the addition part by mass is changed as shown in Table 2) is used in place of the resin particle dispersion solution (1), the coloring agent dispersion solution (2) is used in place of the coloring agent dispersion solution (1), and the pH is kept to be 5.0 during heating at 95° C.

The toner particles are found having a volume average particle diameter $D_{50v}$ of 4.20 μm and a size distribution index GSDv of the volume average particle diameter of 1.20. The shape factor SF1 is 125 showing slightly spherical. It is confirmed by the infrared ray spectrometry of the toner particles that carbodiimido bonds exist in the surfaces.

A toner with external additives is obtained using the toner particles in the same manner as Example 1 and further a developer is produced using the externally-mixed toner and subjected to the same evaluations. The results are shown in Table 2.

Example 3

Toner particles are obtained in the same manner as Example 1, except that the carbodiamide compound is changed to Carbodilite E-01 (manufactured by Nisshinbo Industries), the resin particle dispersion solution (3) (the addition part by mass is changed as shown in Table 2) is used in place of the resin particle dispersion solution (1), and the coloring agent dispersion solution (3) is used in place of the coloring agent dispersion solution (1).

The above-mentioned carbodiamide compound is a water-soluble emulsion resin of a polycarbodiamido resin having a carbodiimido group defined as —N═C═N— and has a solid content of 40%.

The toner particles are found having a volume average particle diameter $D_{50v}$ of 4.20 μm and a size distribution index GSDv of the volume average particle diameter of 1.22. The shape factor SF1 is 119 showing a spherical shape. It is confirmed by the infrared ray spectrometry of the toner particles that carbodiamido bonds exist in the surfaces.

A toner with external additives is obtained using the toner particles in the same manner as Example 1 and further a developer is produced using the externally-mixed toner and subjected to the same evaluations. The results are shown in Table 2.

Example 4

Toner particles are obtained in the same manner as Example 1, except that the carbodiamide compound is changed to Carbodilite E-01 (manufactured by Nisshinbo Industries), the resin particle dispersion solution (4) is used in place of the resin particle dispersion solution (1) and the resin particle dispersion solution (9) (the addition part by mass is changed as shown in Table 2) is used in place of the resin particle dispersion solution (8).

The toner particles are found having a volume average particle diameter $D_{50v}$ of 3.90 μm, a size distribution index GSDv of the volume average particle diameter of 1.22, and a shape factor SF1 of 135 showing a potato-like shape. It is confirmed by the infrared ray spectrometry of the toner particles that carbodiamido bonds exist in the surfaces.

A toner with external additives is obtained using the toner particles in the same manner as Example 1 and further a developer is produced using the externally-mixed toner and subjected to the same evaluations. The results are shown in Table 2.

Example 5

Toner particles are obtained in the same manner as Example 1, except that the carbodiamide compound is changed to Carbodilite E-01 (manufactured by Nisshinbo Industries), the resin particle dispersion solution (5) (the addition part by mass is changed as shown in Table 2) is used in place of all of the resin particle dispersion solutions without using the resin particle dispersion solution (8) and the pH is kept to be 5.0 during the time of heating at 95° C.

The toner particles are found having a volume average particle diameter $D_{50v}$ of 3.60 μm, a size distribution index GSDv of the volume average particle diameter of 1.24, and a shape factor SF1 of 118 showing a spherical shape. It is confirmed by the infrared ray spectrometry of the toner particles that carbodiamido bonds exist in the surfaces.

A toner with external additives is obtained using the toner particles in the same manner as Example 1 and further a developer is produced using the externally-mixed toner and subjected to the same evaluations. The results are shown in Table 2.

Example 6

Toner particles are obtained in the same manner as Example 1, except that the carbodiamide compound is changed to Carbodilite E-01 (manufactured by Nisshinbo Industries), and the resin particle dispersion solution (8) (the addition part by mass is changed as shown in Table 2) is used in place of all of the resin particle dispersion solutions without using the resin particle dispersion solution (1).

The toner particles are found having a volume average particle diameter $D_{50v}$ of 4.10 μm, a size distribution index GSDv of the volume average particle diameter of 1.20, and a shape factor SF1 of 130 showing a potato-like shape. It is confirmed by the infrared ray spectrometry of the toner particles that carbodiamido bonds exist in the surfaces.

A toner with external additives is obtained using the toner particles in the same manner as Example 1 and further a developer is produced using the externally-mixed toner and subjected to the same evaluations. The results are shown in Table 2.

Example 7

Toner particles are obtained in the same manner as Example 1, except that the carbodiamide compound is changed to Carbodilite E-01 (manufactured by Nisshinbo Industries), the resin particle dispersion solution (6) (the addition part by mass is changed as shown in Table 2) is used in place of the resin particle dispersion solution (1), and the pH is kept to be 5.0 during the time of heating at 95° C.

The toner particles are found having a volume average particle diameter $D_{50v}$ of 5.50 μm, a size distribution index GSDv of the volume average particle diameter of 1.27, and a shape factor SF1 of 118 showing a spherical shape. It is confirmed by the infrared ray spectrometry of the toner particles that carbodiamido bonds exist in the surfaces.

A toner with external additives is obtained using the toner particles in the same manner as Example 1 and further a developer is produced using the externally-mixed toner and subjected to the same evaluations. The results are shown in Table 2.

Example 8

Toner particles are obtained in the same manner as Example 1, except that the resin particle dispersion solution (10) is used in place of the resin particle dispersion solutions (1) and (8) and Carbodilite VO2L2.

The toner particles are found having a volume average particle diameter $D_{50v}$ of 4.8 μm, a size distribution index GSDv of the volume average particle diameter of 1.26, and a shape factor SF1 of 130. It is confirmed by the infrared ray spectrometry of the toner particles that carbodiamido bonds exist in the surfaces.

A toner with external additives is obtained using the toner particles in the same manner as Example 1 and further a developer is produced using the externally-mixed toner and subjected to the same evaluations. The results are shown in Table 2.

Comparative Example 1

Toner particles are obtained in the same manner as Example 1, except that the resin particle dispersion solution (7) (the addition part by mass is changed as shown in Table 2) is used in place of the resin particle dispersion solution (1) and no carbodiamide compound is added.

The toner particles are found having a volume average particle diameter $D_{50v}$ of 5.50 μm and a size distribution index GSDv of the volume average particle diameter of 1.30. The shape factor SF1 is 135 showing a potato-like shape.

A toner with external additives is obtained using the toner particles in the same manner as Example 1 and further a developer is produced using the externally-mixed toner and subjected to the same evaluations. The results are shown in Table 2.

According to the above-mentioned results, the toners for electrostatic image development shown in Examples are not only excellent in the fixation property and initial image quality but also capable for retaining image quality in continuous image formation with scarce problems. On the other hand, the toner of Comparative Example is insufficient in off-set resistance and also is inferior in the image quality and image quality retention properties.

What is claimed is:

1. A toner for developing an electrostatic image comprising toner particles obtained by:

forming coagulated particles by mixing a resin particle dispersion solution in which resin particles are dispersed and a coloring agent dispersion solution in which coloring agent particles are dispersed, and fusing the coagulated particles by heating them, wherein:

the surfaces of the toner particles have a chemical structure formed by reaction with a compound having a carbodiimido group;

a size distribution index GSDv of a volume average particle diameter of the toner particles is 1.30 or lower; and a shape factor SF1 of the toner particles is between 100 and 140.

2. The toner for developing an electrostatic image according to claim 1, wherein the resin particles contain a crystalline resin obtained by polymerization of a condensation polymerizable monomer and having a melting point of at least 50° C. and less than 120° C.

3. The toner for developing an electrostatic image according to claim 2, wherein the crystalline resin is a crystalline polyester resin.

4. The toner for developing an electrostatic image according to claim 3, wherein the crystalline polyester resin is a polyester resin obtained by reaction of 1,9-nonanediol with 1,10-decamethylenedicarboxylic acid or by reaction of 1,6-hexanediol with sebacic acid.

5. The toner for developing an electrostatic image according to claim 1, wherein the resin particles contain a non-crystalline resin having a glass transition temperature Tg of 50° C. to 80° C.

6. The toner for developing an electrostatic image according to claim 1, wherein the compound having carbodiimido group is polycarbodiimide resin.

TABLE 2

| | Example 1 | Example 2 | Example 3 | Example 4 | Example 5 | Example 6 | Example 7 | Example 8 | Comparative Example 1 |
|---|---|---|---|---|---|---|---|---|---|
| Resin particle dispersion solution (part by mass) | (1)/(8) (233/100) | (2)/(8) (262/100) | (3)/(8) (247/100) | (4)/(9) (233/100) | (5) (315) | (8) (150) | (6)/(8) (280/100) | (10) | (1)/(7) (233/100) |
| Coloring agent dispersion solution | (1) | (2) | (3) | (1) | (1) | (2) | (1) | (1) | (1) |
| Carbodiamide compound (part by mass) | Carbodilite VO2L2(10) | Carbodilite VO2L2(5) | Carbodilite E-01(10) | Carbodilite E-01(10) | Carbodilite E-01(10) | Carbodilite E-01(10) | Carbodilite E-01(10) | — | — |
| Toner particle diameter (μm) | 4.50 | 4.20 | 4.20 | 3.90 | 3.60 | 4.10 | 5.50 | 4.80 | 5.50 |
| Toner shape factor | 131 | 125 | 119 | 135 | 118 | 130 | 118 | 130 | 135 |
| Lowest fixation temperature (° C.) | 120 | 120 | 110 | 110 | 100 | 140 | 100 | 120 | 120 |
| Off-set occurrence temperature (° C.) | 200 or higher | 200 or higher | 200 or higher | 200 or higher | 200 | 200 or higher | 150 | 200 | 140 |
| Image quality | G2 | G2 | G2 | G2 | G2 | G2 | G2 | G2 | G4 |
| Image quality retention property | G1 | G1 | G1 | G1 | G1 | G1 | G2 | G2 | G4 |

7. The toner for developing an electrostatic image according to claim 1, wherein the coagulated particles further contain releasing agent particles.

8. The toner for developing an electrostatic image according to claim 1, wherein the toner particles have a volume average particle diameter $D_{50V}$ in a range of between 3.0 to 9.0 μm.

9. The toner for developing an electrostatic image according to claim 8, wherein the toner particles have a volume average particle diameter $D_{50V}$ in a range of between 3.0 to 5.0 μm.

10. The toner for developing an electrostatic image according to claim 1, wherein the shape factor SF1 of the toner particles is between 110 to 135.

11. A resin particle dispersion solution for a toner for developing an electrostatic image comprising dispersed resin particles obtained by:

emulsifying or dispersing monomers comprising a condensation polymerizable monomer by mixing them in a water-based medium; and condensation-polymerizing the mixed monomers, wherein:

the surfaces of the resin particles contain a compound having a carbodiimido group;

a size distribution index GSDv of a volume average particle diameter of the resin particles is 1.30 or lower; and a shape factor SF1 of the resin particles is between 100 and 140.

12. The resin particle dispersion solution for a toner for developing an electrostatic image according to claim 11, wherein the resin particles contain a crystalline resin obtained by polymerization of a condensation polymerizable monomer and having a melting point of at least 50° C. and less than 120° C.

13. The resin particle dispersion solution for a toner for developing an electrostatic image according to claim 11, wherein the volume average particle diameter of the resin particles in the resin particle dispersion solution is in a range of 0.05 to 2.0 μm.

14. The resin particle dispersion solution for a toner for developing an electrostatic image according to claim 11, wherein a catalyst to be used for the condensation polymerization is an acid having a surface activation effect.

15. The resin particle dispersion solution for a toner for developing an electrostatic image according to claim 14, wherein the acid having a surface activation effect is dodecylbenzenesulfonic acid, isopropylbenzenesulfonic acid, or camphersulfonic acid.

16. The resin particle dispersion solution for a toner for developing an electrostatic image according to claim 11, wherein a catalyst to be used for the condensation polymerization is a metal catalyst containing a rare earth element.

17. The resin particle dispersion solution for a toner for developing an electrostatic image according to claim 16, wherein the metal catalyst containing a rare earth element includes an alkylbenzene sulfonic acid salt, an alkylsulfuric acid ester salt, or a triflate structure.

18. The resin particle dispersion solution for a toner for developing an electrostatic image according to claim 11, wherein a catalyst to be used for the condensation polymerization is a hydrolyzing enzyme.

19. The resin particle dispersion solution for a toner for developing an electrostatic image according to claim 18, wherein the hydrolyzing enzyme is lipase.

20. The resin particle dispersion solution for a toner for developing an electrostatic image according to claim 11, wherein the resin particles have a volume average particle diameter $D_{50V}$ in a range of between 3.0 to 9.0 μm.

* * * * *